US006578322B2

(12) United States Patent
Kintop

(10) Patent No.: US 6,578,322 B2
(45) Date of Patent: Jun. 17, 2003

(54) ROOF EDGE SYSTEM

(75) Inventor: Mike Kintop, Mentor, OH (US)

(73) Assignee: W.P. Hickman Systems, Inc., Solon, OH (US)

( * ) Notice: Subject to any disclaimer, the term of this patent is extended or adjusted under 35 U.S.C. 154(b) by 0 days.

(21) Appl. No.: 09/966,285

(22) Filed: Sep. 28, 2001

(65) Prior Publication Data

US 2003/0061771 A1 Apr. 3, 2003

(51) Int. Cl.[7] ..... E04D 1/36

(52) U.S. Cl. ..... 52/96; 52/60; 52/97; 52/300; 52/84

(58) Field of Search ..... 52/58, 94, 96, 52/97, 300, 84, 60

(56) References Cited

U.S. PATENT DOCUMENTS

RE26,056 E * 7/1966 Hickman
3,503,162 A * 3/1970 Ward
3,533,201 A * 10/1970 Tyler
3,624,973 A * 12/1971 Attaway
4,483,112 A * 11/1984 Rueblinger
4,549,377 A * 10/1985 Castle
4,641,476 A * 2/1987 Webb et al.
4,662,129 A * 5/1987 Hickman ..... 52/96
4,759,157 A * 7/1988 Webbg et al.
4,800,689 A * 1/1989 Lane
5,927,023 A * 7/1999 Kittilstad

* cited by examiner

*Primary Examiner*—Robert Canfield
(74) *Attorney, Agent, or Firm*—Renner, Otto, Boisselle & Sklar, LLP

(57) ABSTRACT

A roof edge system includes a water dam and a fascia secured to the water dam with spring clips. The water dam is mounted to a roof and extends upwardly to a peak before extending downwardly along the face of an outside wall. Each spring clip is mounted to the water dam, and is covered by the fascia. The fascia includes a catch that cooperates with a detent on the spring clip to hold the fascia in place. The fascia extends over the peak of the water dam and down the wall to a hook portion that hooks over an outwardly extending lip at the lower end of the water dam. The resulting system provides a hidden connection between the water dam and the fascia, is inexpensive, and can be quickly and easily assembled and disassembled without any tools, while also providing superior wind and water resistance and improving the appearance of the roof edge.

18 Claims, 2 Drawing Sheets

ROOF EDGE SYSTEM

FIELD OF THE INVENTION

The present invention relates generally to roof edge systems, and more particularly, to systems for roof edge termination for built-up roof and modified bitumen roofing systems.

BACKGROUND OF THE INVENTION

Built-up roofing (BUR) systems generally are applied over a substantially rigid roof deck on a flat or low slope roof of a building to provide a weather barrier. BUR systems include a membrane generally made up of multiple layers of bitumen-impregnated felt with a separately applied coating of bitumen on top of each layer of felt. A protective layer of small stones or other aggregate materials is embedded in and covers the top bitumen coating. Such a system has a relatively low cost in view of its durability and water resistance.

Various devices are used at the edge of such a roof to anchor the sheets of roofing membranes, to retain gravel ballast or other roofing materials applied on the roofing membranes, and/or to minimize or eliminate the ability of water to flow over the edge of the roof deck. The majority of roofing failures occur at the edge of the roof. Damage often occurs from water entering the building structure, for example by flowing over the edge of the roof and down an outside wall where it may enter the structure and cause damage to the building.

Generally, an upwardly extending water dam is mounted at the edge of the roof and a fascia is mounted over the water dam. The fascia generally also extends downward, parallel to the outside wall of the building. The fascia improves the appearance of the roof edge and further increases resistance to wind-driven rain and wind uplift loads. Unfortunately, existing systems often require non-standard water dams and/or fascia, and/or are complicated and/or time consuming to install.

In addition, some of the elements of the roofing system are secured to one another and/or the roof with fasteners passing through one or more of the elements. The fasteners piercing the various elements of the roofing system can promote unsightly corrosion and also can provide a pathway for moisture to pass through the roofing system to damage the building.

SUMMARY OF THE INVENTION

The present invention provides a superior roof edge system that includes a water dam and a fascia. The fascia is secured to the water dam with spring clips mounted to the face of the water dam. The spring clips allow the system to be quickly and easily installed using substantially standard materials. The relatively inexpensive spring clips are hidden from view once the fascia is installed. The fascia obscures and protects the fasteners from the weather, and in turn is held securely in place by the cooperating water dam and spring clips.

Specifically, the present invention provides a roof edge system that includes a water dam and a fascia secured to the water dam with at least one spring clip, and preferably two spring clips. The system may also include a flashing material covering at least a portion of the roofing material and extending over at least a portion of the face of the water dam. Each spring clip is mounted over the BUR flashing membranes extending up the face of the water dam and the fascia is mounted over the water dam and the spring clips. The resulting system provides a hidden connection between the water dam and the fascia, is inexpensive, and can be quickly and easily assembled and disassembled without any tools, while also providing superior wind and water resistance, and improving the appearance of the roof edge.

More particularly, the water dam is mountable on a roof deck extending upwardly to a peak before extending downwardly along the face of an outside wall. The water dam has an inclined face portion and a wall portion extending from the distal edge of the face portion. The wall portion forms an acute angle relative to the face portion. In other words, the water dam has a generally inverted V-shape formed by the inclined face portion and the wall portion.

The spring clip is mountable on the inclined face portion of the water dam. The spring clip has a first portion mountable on the water dam, a second portion spaced from the first portion, and a detent portion interposed therebetween. The detent portion of the spring clip has a generally L-shape cross-section and a catch portion of the fascia has a corresponding L-shape cross-section. The spring clip may also include a locating portion extending at an acute angle from the base portion for spacing the spring clip from an upper end of the face portion of the water dam.

The fascia member has means for mounting the fascia member on the water dam and the spring clip, including means for holding the distal end of the wall portion of the water dam and means for engaging the detent portion of the spring clip. The fascia extends over the peak of the water dam and down the wall to a hook portion that hooks over the lower end of the water dam. The fascia also includes a catch that cooperates with a detent on the spring clip to hold the fascia in place.

More particularly, the fascia member has a resilient overhang portion extendable over the spring clip and at least a portion of the inclined face portion of the water dam. The end of the overhang portion includes a catch adapted to engage the detent portion of the spring clip. The fascia member also has a hook portion connected to an opposite end of the overhang portion. The fascia member includes a wall portion extending from the overhang portion and forming an acute angle relative to the overhang portion. The hook portion is connected to the distal end of the wall portion and has a generally U-shape cross-section. The hook portion is adapted to receive the distal end of the wall portion of the water dam. The fascia member is thereby held to the water dam between the hook portion and the spring clip.

The present invention also provides a method of mounting the roof edge system on a roof deck. The method includes the steps of: mounting a water dam on the roof deck; mounting a spring clip on the face portion of the water dam; and mounting a fascia member on the water dam and spring clip. The step of mounting the fascia member includes pressing the fascia member downwardly on the water dam and spring clip until the hook portion passes the distal end of the wall portion of the water dam, and the catch portion is in position to engage the detent portion of the spring clip.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
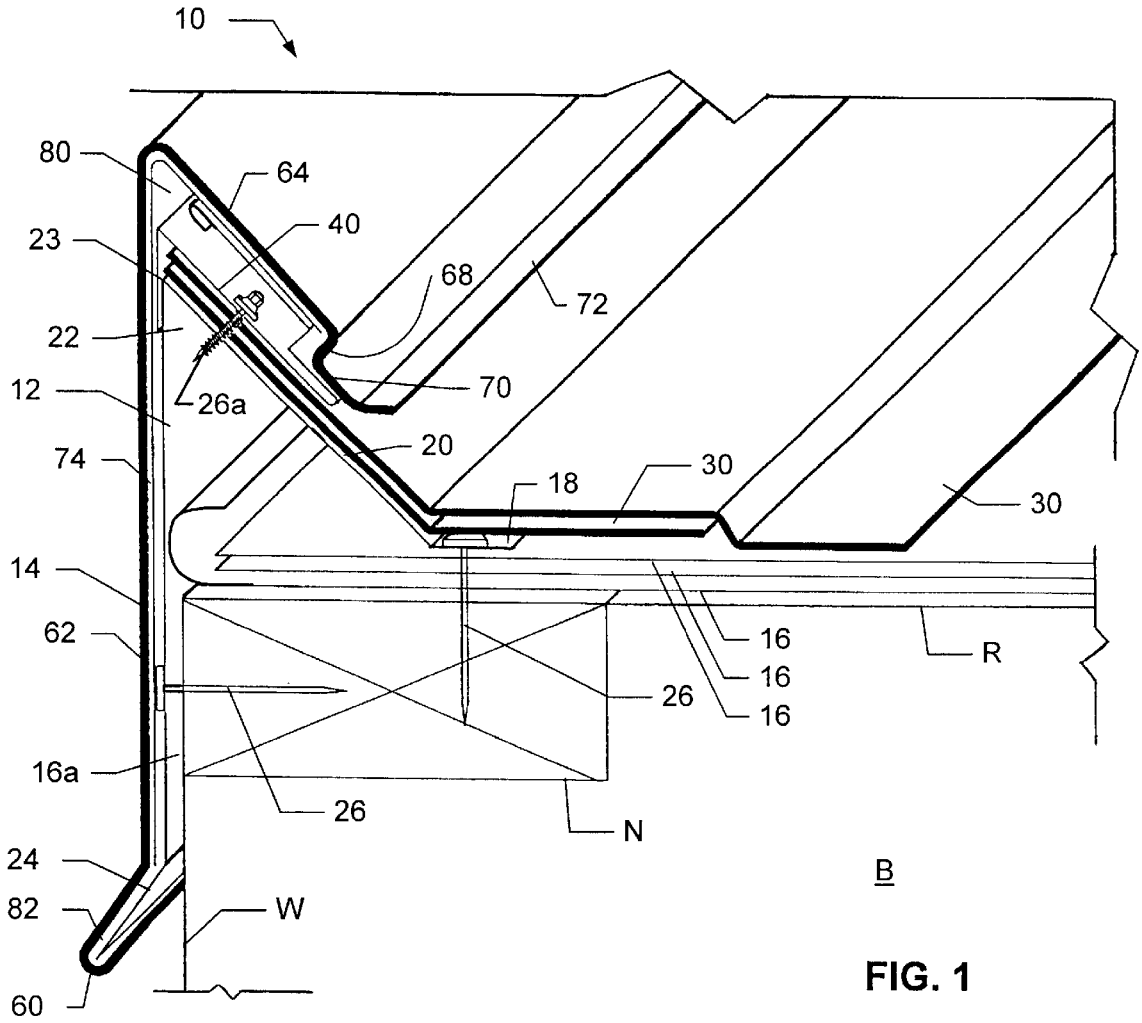
FIG. 1 is a cross-sectional and isometric view of the roof edge system formed in accordance with the present invention.

Referring initially to FIG. 1, a building generally designated B, is shown as having a generally flat roof deck R. An edge strip of wood, generally referred to as a nailer N, is nailed or otherwise suitably secured around the perimeter of the roof deck at the edge of the roof and the top of an outside wall W. An upper surface of the nailer thus forms the edge of the roof deck, and a face of the nailer forms the top of the wall.

The present invention provides a roof edge system 10 that forms a raised edge or lip at the edge of the roof deck R that provides a protective barrier, directing water away from the roof edge and the top of the wall W. The system includes a water dam 12 and a fascia 14 operable with an improved means for installing and retaining the fascia on the water dam.

As shown in FIG. 1, the roof deck R is covered with a roofing material 16 in the usual manner. The roofing material generally includes a flexible sheet material such as an elastomeric material, tarred paper, asphalt roofing felt, or other suitable roofing materials substantially impervious to wind and water. Exemplary roofing materials include BUR and modified bitumen, for example. The roofing material may be covered with a gravel ballast (not shown) or other material for improved resistance to wind and sunshine.

The roofing material usually is applied in a plurality of layers, and usually at least one ply or layer of roofing material, for example the base ply 16*a* shown in FIG. 1, extends over the nailer and turns upwardly over the subsequent layers. The roof adhesive generally is applied as a liquid and the upturned curled edge of the base ply of the roofing felt helps to retain the roof adhesive and prevent it from running down the face of the building. The upturned edge also reduces the possibility that water could flow from the roof deck R down the outside wall W of the building.

In the illustrated embodiment, the water dam 12 is mounted on the roofing material 16, adjacent the edge of the roof. The illustrated water dam has an inverted V-shape. At a distal end of one leg of the "V," the water dam includes a base flange 18 that is mountable substantially flush against the roofing material. From the edge of the base flange, an inclined face panel 20 extends upwardly from the roof deck, forming an obtuse angle relative to the base flange, and forming the first leg of the "V." An upright wall panel 22, forming a second leg of the "V," extends at an acute angle from end of the face panel, thereby forming the peak 23 of the inverted V-shape water dam. The water dam further includes an angled lip 24 at the distal end of the wall panel. The water dam generally is mounted with the wall panel extending downwardly, generally parallel to the face of the wall of the building, with the lip extending outwardly, away from the wall.

The water dam 12 is secured to the building to resist wind uplift. In the illustrated embodiment, the base flange 18 is secured to the top of the nailer or other portion of the roof deck, and the wall panel 22 is secured to the face of the nailer or other portion of the wall with fasteners 26 such as the illustrated nails. At least one of the fasteners also secures at least the base ply 16*a* of the roofing material to the building. All fasteners referred to herein include without limitation such fasteners as nails, screws or an adhesive, although nails are most commonly used at this time.

The fasteners 26 in the base flange 18 of the water dam 12 are protected by one or more layers of a BUR flashing material 30 extending over portions of is the roofing material 16, as well as the base flange and face panel 20 of the water dam. Two layers of flashing material are shown in FIG. 1. Flashing material extending beyond the distal edge of the face panel (the upper edge i n FIG. 1) may be trimmed flush with the peak 23 of the water dam. The flashing material covers and protects the seam between the water dam and the roofing material from water, as well as protecting the fasteners 26 and the openings they form in the base flange and the roofing material.

The fascia 14, water dam 12 and flashing materials 30 generally are formed of longitudinally extending sections placed in an end-to-end relation along the perimeter of the roof deck. Each of the fascia and water dam is made of sheet material such as a polymeric material, galvanized steel sheet, aluminum alloy, or stainless steel sheet and may have a weather-resistant coating.

The components of the illustrated system 10 thus far described do not require any specialized materials or techniques but are readily available, standard components used in various roofing systems. A unique element of the illustrated system, however, is the means for attaching the fascia 14 to the water dam 12; at least one or a plurality of spring clips 40 mounted to the face panel 20 of the water dam help hold the fascia to the water dam. The spring clips generally are spaced at periodic intervals along the length of the water dam, for example, at five foot (approximately 152 cm) intervals. The spring clips generally are formed of a resilient sheet material, such as galvanized spring steel.

Figure 2:
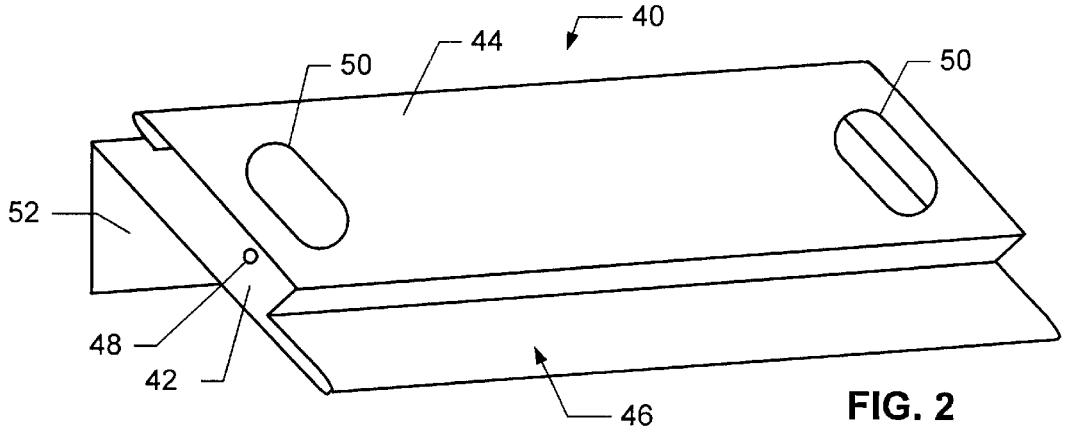
FIG. 2 is a perspective view of an exemplary spring clip.

Referring also to FIG. 2, each spring clip 40 has a generally U-shape cross-section with a first leg 42 mountable generally parallel and adjacent to the face panel 20 of the water dam 12, a second leg 44 biased to a position spaced from the first leg, and an L-shape detent portion 46 interconnecting and spacing the first and second legs.

To facilitate fastening the spring clip 40 to the water dam 12, the first and second legs 42, 49 of the spring clip have one or more pairs of substantially aligned openings 48, 50 therein. The illustrated embodiment has two pairs of openings. The illustrated pair of openings 50 in the second leg generally are larger to accommodate a tool and a fastener, such as the illustrated screw 26*a* in FIG. 1, inserted and secured through a respective pair of openings 48 in the first leg. In the illustrated embodiment, the fasteners simultaneously secure both the flashing material 30 and the spring clip to the water dam. The spring clip may have one or more additional or alternative attachment points for one or more fasteners that would not require a corresponding opening in the second leg of the spring clip.

The illustrated spring clip 40 also includes a locating foot 52 extending at an acute angle from the distal end of the first leg 42 of the spring clip, giving the spring clip a modified N-shape cross-section. The locating foot provides a convenient means for consistently locating the spring clips at a predetermined distance from the peak 23 of the water dam 12, but may be omitted.

The fascia 14 covers the spring clips 40 and the upper end of the face panel 20 of the water dam 12. More particularly, the fascia generally is mounted over the water damn to extend over the face panel of the water dam and down the face of the wall. The fascia thus covers the fasteners 26 in the wall panel 22 as well as the fasteners 26, the spring clips 40, and the face panel 20 of the water dam. In the illustrated embodiment, the bottom edge of the fascia extends below the bottom edge of the nailer at least one inch (approximately 2.5 cm). At the bottom edge the fascia angles outwardly and back on itself to form a U-shape drip edge 60 or hook. The fascia usually is mounted such that the open end of the "U" faces toward the wall, and the bight of the U-shape drip edge 82 engages the lip 24 of the water dam 12.

From the drip edge 60, an upright wall member 62 of the fascia 14 extends to a peak where an inclined member 64 forms an acute angle with the upright wall member. The inclined member is designed to overhang or extend over and generally parallel to at least a portion of the face panel 20 of the water dam 12.

The distal end of the inclined member 64 of the fascia 14 includes a generally L-shape clamping member 66. The clamping member has a catch portion 68 that extends toward the upright wall member 62 and a sled portion 70 that extends away from and generally parallel to the inclined member. At the distal end of the clamping member, a lifting element 72 extends upwardly, away from the upright wall member. The fascia also includes a joint cover 74, for sealing the joint between adjacent longitudinal sections of fascia. The joint cover extends parallel to a portion of the fascia member adjacent the upright wall member 62 and the inclined member 64, and fits snugly against the respective inside surfaces of the fascia.

Figure 3:
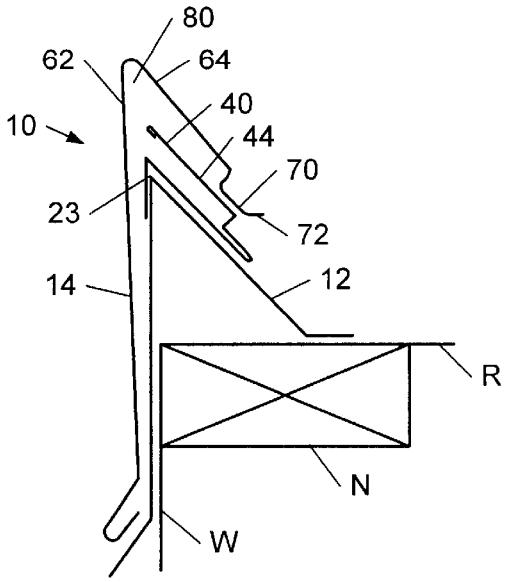
FIGS. 3–5 are sequential schematic cross-sectional views of the roof edge system of the present invention that illustrate assembly of the system.
Figure 4:
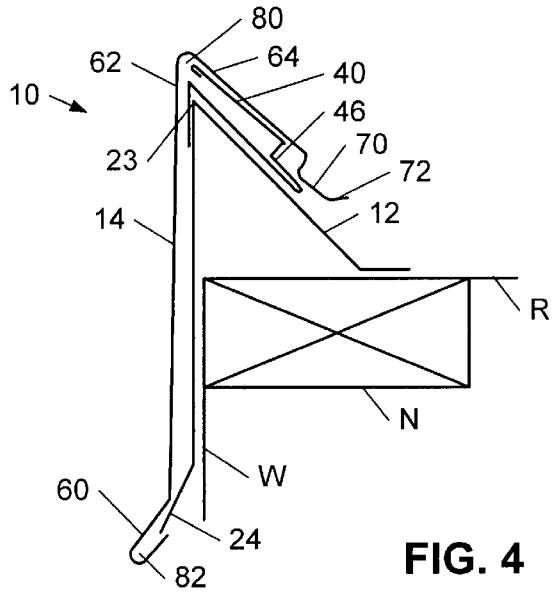
Figure 5:
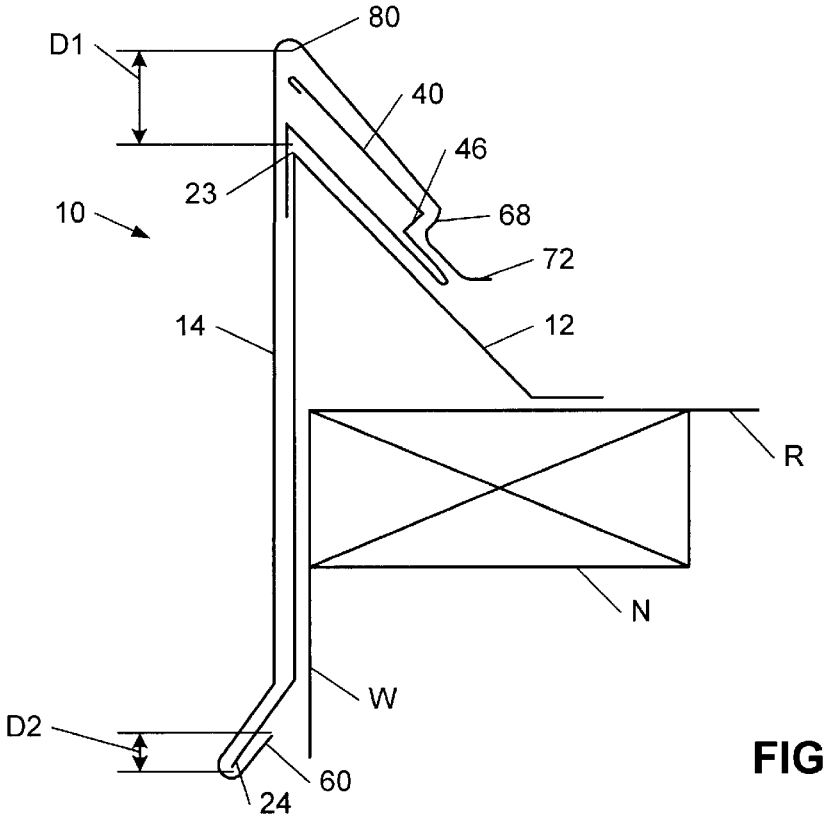

The installation of the fascia on the water dam will be explained with reference to FIGS. 3–5. Once the roofing material 16 (FIG. 1), water dam 12, flashing material 30 (FIG. 1), and spring clips 40 are in place as described above, the system is ready for installation of the fascia 14. The fascia is placed over the spring clip and the water dam such that the peak 23 of the water dam is in the bight 80 between the upright wall member 62 and the inclined member 64. Then the fascia is pushed downwardly until the open end of the U-shape drip edge 60 moves past the lip 24 of the water dam. As the fascia is moved downward, the sled portion 70 of the fascia rides along the second leg 44 of the spring clip 40. The resiliency of the fascia material allows the inclined member 64 to flex relative to the upright wall member 62, the angle of the bight 80 increasing slightly as a result. The sled portion is urged downwardly as well, against the second leg and then against the detent portion 46 of the spring clip. The resiliency of the spring clip 40 material also allows the second leg of the spring clip to flex toward the first leg of the spring clip and the peak 23 of the water damn.

When the fascia 14 is released, the resiliency of the fascia material and the spring clip 40 material urges both elements to return to their original positions. The fascia moves upwardly, engaging the lip 24 of the water dam 12 in the bight 82 of the fascia drip edge 60. Acting against resiliency of the fascia material and the spring clip material, the detent portion 46 of the spring clip 40 and the catch portion 68 of the fascia cooperate to keep the catch portion from moving past the detent portion. The catch portion and the detent position cooperate with the drip edge 60 and the lip of the water dam to retain the fascia on the water dam. In other words, the cooperation of the spring clip, the fascia, and the lip of the water dam holds the fascia securely in place. Other cooperatively-shaped catch portions and corresponding detent portions are contemplated within the scope of the present invention.

Once the fascia 14 is in place, the water dam 12 and the fasteners 26 (FIG. 1) holding it to the building are covered by the fascia and/or the flashing material 30 (FIG. 1), thereby protecting any openings in the system 10 that penetrate the roofing material 16 (FIG. 1). Biasing the catch portion 68 of the fascia against the detent portion 46 of the spring clip 40 and/or the face panel 20 (FIG. 1) of the water dam also helps to prevent the entry of wind-driven water between the fascia and the water dam.

An advantage of the present system is that the fascia 14 can be removed and replaced without any tools and without damaging either the fascia or the water dam. To remove the fascia, the fascia is moved downwardly against the water dam 12 until the open end of the drip edge 60 moves past the distal end of the lip 24 of the water dam and can be pulled outwardly, free from the lip 24 of the water dam. The fascia can then be released and allowed to move upwardly until the catch portion 68 engages the detent portion 46 of the spring clip 40. To disconnect the fascia from the spring clip, the lifting element 72 is lifted up, away from the face panel 20 of the water dam. The catch portion can then be moved past the detent portion and the fascia is free to be removed.

To facilitate the quick installation, the distance D1 between the distal end of the lip 24 of the water dam 12 and the free distal end of the U-shape drip edge 60 generally should be less than the distance D2 between the peak 23 of the water dam and the corresponding inner surface in the bight 80 of the fascia 14.

In summary and returning to FIG. 1, the roof edge system 10 provided by the present invention includes a water dam 12, at least one spring clip 40 and a fascia 14. The water dam is mounted at an outside edge of the roof deck and secured to the roof deck and/or the wall of the building. At least one spring clip is secured to the face panel 20 of the water dam. The fascia is pressed downwardly over the water dam and the spring clip until the open end of the U-shape drip edge 60 passes the lip 24 of the water dam, and the catch portion 68 passes the detent portion 46. The fascia is then released, and the resiliency of the spring clip material and the fascia material push the fascia into engagement with the lip of the water dam and the detent portion of the spring clip to prevent accidental removal of the fascia. To remove the fascia, the fascia is moved downwardly against the spring clip until the drip edge clears the lip of the water dam and can be pulled free. Then the lifting element 72 is raised and the catch portion can move past the detent portion of the spring clip to complete removal of the fascia.

As the above description of the illustrated embodiment has made clear, the present invention provides a roof edge system that requires relatively few and inexpensive non-standard components, particularly the spring clips described herein, that allow the system to be quickly and inexpensively installed along a roof edge. The spring clips cooperate with elements of the water dam and the fascia to attach and retain the fascia on the water dam, the fascia covering the spring clips and the fasteners that mount the spring clips to the water dam, thereby also providing a hidden and protected connection to the roof. In addition, the locating foot provides easy and accurate spacing of the spring clip with respect to the peak of the water dam.

Although the invention has been shown and described with respect to a certain illustrated embodiment, equivalent alterations and modifications will occur to others skilled in the art upon reading and understanding the specification and the annexed drawings. For example, the detent portion of the spring clip may have a wide variety of shapes and is not intended to be limited to the shape shown in the illustrated embodiment as long as the spring clip includes a detent portion cooperative with a corresponding catch connected to the fascia. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment of the invention.

What is claimed is:

1. A roof edge system, comprising:

a water dam mountable on a roof deck adjacent an edge of a roof, the water dam having an inclined face portion extending upward for directing water away from the roof edge, and a wall portion extending downward from a distal edge of the face portion beyond the roof edge and forming an acute angle relative to the face portion;

a spring clip mountable on the inclined face portion of the water dam, the spring clip including an inclined base portion adapted to parallel the inclined face portion of the water dam that has an opening therein accessible from above, and a detent portion extending upward from the base portion;

a fastener for securing the base portion of the spring clip to the face portion of the water dam through the opening in the spring clip; and a fascia member having a resilient overhang portion extendable over the spring clip, the fastener and at least a portion of the inclined face portion of the water dam, and a hook portion connected to the overhang portion and extending downward from an end thereof beyond the roof edge, the overhang portion including a catch adapted to engage the detent portion of the spring clip, and the hook portion is adapted to receive a distal end of the wall portion of the water dam; whereby the fascia member is held to the water dam between the hook portion and the spring clip.

2. A system as set forth in claim 1, wherein the water dam has a generally inverted V-shape formed by the inclined face portion and the wall portion.

3. A system as set forth in claim 1, wherein the distal end of the wall portion is inclined outwardly, away from the face portion, to form a lip.

4. A system as set forth in claim 1, wherein the spring clip has a spring portion spaced from the base portion to engage the fascia member, and the detent portion is interposed therebetween.

5. A system as set forth in claim 1, wherein the fascia member includes a wall portion extending from the overhang portion and forming an acute angle relative to the overhang portion and the hook portion is connected to the distal end of the wall portion.

6. A system as set forth in claim 5, wherein the hook portion has a generally U-shape cross-section.

7. A system as set forth in claim 1, wherein the fascia member and the water dam are longitudinally extending elements.

8. A system as set forth in claim 1, wherein the spring clip further a comprises a locating portion extending at an acute angle from the base portion for spacing the spring clip from an upper end of the face portion of the water dam.

9. A system as set forth in claim 1, wherein the system further comprises a plurality of spring clips.

10. A system as set forth in claim 9, wherein the plurality of spring clips are substantially evenly longitudinally spaced along the water dam.

11. A system as set forth in claim 1, wherein a roofing material covers the roof deck and the water dam is mounted on the roofing material, further comprising a flashing material covering at least a portion of the roofing material and extending over at least a portion of the face portion of the water dam.

12. A system as set forth in claim, 11 wherein the spring clip is mounted to the water dam with at least one fastener, and the fastener also secures the flashing to the water dam.

13. A system as set forth in claim 1, wherein the water dam further includes a mounting flange at a lower end of the face portion of the water dam and a fastener for mounting the flange to the roof deck.

14. A system as set forth in claim 1, wherein at least one fastener connects the mounting flange to the roof deck and at least one other fastener connects the wall portion of the water dam to the roof deck.

15. A system as set forth in claim 1, wherein the detent portion of the spring clip has a generally L-shape cross-section and the catch portion of the fascia has a corresponding L-shape cross-section.

16. A spring clip suitable for use with a water dam mountable on a roof deck adjacent an edge of a roof, the water dam having an inclined face portion extending upward for directing water away from the roof edge and a wall portion extending downward from the distal edge of the face portion beyond the roof edge and forming an acute angle relative to the face portion; and a fascia member having a resilient overhang portion extendable over at least a portion of the inclined face portion of the water dam, and a hook portion connected to the overhang portion, the hook portion extending downward from an end of the face portion beyond the roof edge, the hook portion adapted to receive a distal end of the wall portion of the water dam, and the overhang portion including a catch, the spring clip comprising:

an inclined base portion mountable on the inclined face portion of the water dam via a fastener that passes through an opening in the base portion to engage the face portion of the water dam, the opening being accessible from above so that the spring clip can be installed from the roof deck, a locating portion extending downward at an acute angle from an end of the base portion to extend over an upper end of the inclined face portion of the water dam for spacing the spring clip from an upper end of the face portion of the water dam, a spring portion spaced from the base portion to engage the overhang portion of the fascia member, and a detent portion extending upward from the base portion that is interposed between the base portion and the spring portion and is adapted to cooperate with the catch on the fascia member such that the fascia member may be held and retained in position relative to the water dam between the end of the wall portion of the water dam and the spring clip.

17. A method of mounting a roof edge system on an edge of a roof from a roof deck, comprising:

mounting a water dam on the roof deck at the edge of a roof, the water dam having an inclined face portion extending upward for directing water away from the roof edge, and a wall portion extending downward from the distal edge of the face portion beyond the roof edge and forming an acute angle relative to the face portion;

mounting a spring clip on the face portion of the water dam from the roof deck using a fastener in a base portion of the spring clip, the spring clip including the base portion having an opening accessible from above for passage of the fastener therethrough and a detent portion extending upward from the base portion; and mounting a fascia member on the water dam and spring clip, the fascia member including an inclined overhang portion having a catch portion for engaging the detent portion of the spring clip, and a hook portion connected to the overhang portion and adapted extend downward beyond the roof edge to receive a distal end of the wall portion of the water dam;

wherein mounting the fascia member further includes:

pressing the fascia member downwardly on the water dam and spring clip until the hook portion passes the distal end of the wall portion of the water dam and the catch portion is in position to engage the detent portion of the spring clip, thereby covering the opening in the base portion of the spring clip and at least part of the face portion of the water dam.

18. A roof edge system, comprising:

a water dam mountable on a roof deck adjacent an edge of a roof, the water dam having a generally inverted V-shape formed by an inclined face portion extending upward for directing water away from the roof edge and a wall portion extending downward from the distal edge of the face portion beyond the roof edge and forming an acute angle relative to the face portion, the distal end of the wall portion inclined outwardly, away from the face portion to direct water away from an upright face of the roof edge;

a spring clip having a first portion mountable on the inclined face portion of the water dam, a second portion spaced from the first portion, and a detent portion interposed therebetween, the first portion including an opening therethrough accessible from above securing the first portion of the spring clip to the face portion of the water dam; and a fascia member having a resilient overhang portion extendable over the opening in the spring clip and at least a portion of the inclined face portion of the water dam, and a wall portion extending downward from the overhang portion beyond an edge of the roof edge and forming an acute angle relative to the overhang portion, the distal end of the wall portion including a generally U-shape hook portion adapted to receive the distal end of the wall portion of the water dam, and the overhang portion including a catch adapted to engage the detent portion of the spring clip and to form a drip edge; whereby the fascia member is held to the water dam between the hook portion and the spring clip.

* * * * *